US008684662B2

(12) United States Patent
Jiang et al.

(10) Patent No.: US 8,684,662 B2
(45) Date of Patent: Apr. 1, 2014

(54) RING SEGMENT WITH IMPINGEMENT AND CONVECTIVE COOLING

(75) Inventors: Nan Jiang, Jupiter, FL (US); Samuel R. Miller, Jr., Port St. Lucie, FL (US); Friedrich Rogers, West Palm Beach, FL (US); Hubert Paprotna, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 874 days.

(21) Appl. No.: 12/875,224

(22) Filed: Sep. 3, 2010

(65) Prior Publication Data

US 2012/0057969 A1 Mar. 8, 2012

(51) Int. Cl.
*F01D 11/08* (2006.01)

(52) U.S. Cl.
USPC ..... 415/115; 415/116; 415/173.1

(58) Field of Classification Search
USPC ..... 415/115, 116, 173.1, 173.4, 178
See application file for complete search history.

(56) References Cited

U.S. PATENT DOCUMENTS

| | | | | |
|---|---|---|---|---|
| 3,728,039 | A | 4/1973 | Plemmons et al. | |
| 3,825,364 | A | 7/1974 | Halila et al. | |
| 4,269,032 | A | 5/1981 | Meginnis et al. | |
| 4,296,606 | A | 10/1981 | Reider | |
| 4,497,610 | A * | 2/1985 | Richardson et al. | 415/116 |
| 4,573,865 | A | 3/1986 | Hsia et al. | |
| 4,679,981 | A | 7/1987 | Guibert et al. | |
| 4,752,184 | A | 6/1988 | Liang | |
| 5,370,499 | A | 12/1994 | Lee | |
| 5,380,150 | A | 1/1995 | Stahl | |
| 5,690,472 | A | 11/1997 | Lee | |
| 6,155,778 | A | 12/2000 | Lee et al. | |
| 7,033,138 | B2 | 4/2006 | Tomita et al. | |
| 7,182,576 | B2 | 2/2007 | Bunker et al. | |
| 7,186,084 | B2 | 3/2007 | Bunker et al. | |
| 7,246,993 | B2 | 7/2007 | Bolms et al. | |
| 7,670,108 | B2 | 3/2010 | Liang | |
| 8,388,300 | B1 * | 3/2013 | Liang | 415/1 |
| 2003/0026697 | A1 * | 2/2003 | Subramanian et al. | 416/97 R |
| 2005/0058534 | A1 * | 3/2005 | Lee et al. | 415/116 |
| 2008/0118346 | A1 * | 5/2008 | Liang | 415/115 |
| 2009/0079139 | A1 | 3/2009 | Schiavo et al. | |
| 2009/0081033 | A1 | 3/2009 | Schiavo et al. | |
| 2010/0047061 | A1 | 2/2010 | Morrison | |

FOREIGN PATENT DOCUMENTS

| | | | |
|---|---|---|---|
| EP | 0694677 | A1 | 1/1996 |
| WO | WO 2010009997 | A1 * | 1/2010 |

* cited by examiner

*Primary Examiner* — Edward Look
*Assistant Examiner* — Jesse Prager

(57) ABSTRACT

A ring segment for a gas turbine engine includes an outer panel defining a structural body for the ring segment. An outer side of an inner panel is attached to an inner side of the outer panel at an interface, and an inner side of the inner panel defines a portion of a hot gas path through the gas turbine engine. An outer side of the outer panel, opposite from the interface, is in communication with a source of cooling air. A plurality of impingement holes extend through the outer panel from the outer side to the inner side of the outer panel for directing impingement air to the outer side of the inner panel. The outer and inner panels define a plurality of flow channels at the interface for effecting convective cooling of the outer panel along the flow channels between the outer and inner panels.

18 Claims, 4 Drawing Sheets

RING SEGMENT WITH IMPINGEMENT AND CONVECTIVE COOLING

FIELD OF THE INVENTION

The present invention relates to a ring structure for gas turbine engines and, more particularly, to cooling of ring segments forming a ring structure for a gas turbine engine.

BACKGROUND OF THE INVENTION

It is known that the maximum power output of a combustion turbine is achieved by heating the gas flowing through the combustion section to as high a temperature as is feasible. The hot gas, however, heats the various turbine components, such as the combustor, transition ducts, vanes and ring segments, which it passes when flowing through the turbine. One aspect limiting the ability to increase the combustion firing temperature is the ability of the turbine components to withstand increased temperatures. Consequently, various cooling methods have been developed to cool turbine hot parts.

In the case of cooling of ring segments, ring segments typically may include an impingement plate welded to the ring segment and defining a plenum between the impingement plate and the ring segment. The impingement plate may include holes for passage of cooling air into the plenum. It has been noted that welding produces the potential for the impingement plate to crack as a result of the welding altering the material properties of the impingement plate. In addition, it has been observed that in the case of ring segments comprising thick panels defining a portion of a hot gas path through the turbine, the cooling provided by the impingement plate may not provide adequate cooling to the thick panel. In addition, further cooling structure, such as elongated passages that may be machined in the ring segment panel, may experience heating of cooling air channeled through the panel, with the result that portions of the panel do not receive adequate cooling.

SUMMARY OF THE INVENTION

In accordance with an aspect of the invention, a ring segment is provided for a gas turbine engine. The ring segment may comprise an outer panel defining a structural body for the ring segment. The outer panel may have a leading edge, a trailing edge, a first mating edge, a second mating edge, an outer side and an inner side, the outer side being in communication with a source of cooling air. The ring segment may further include an inner panel including an outer side and an inner side wherein the outer side of the inner panel is attached to the inner side of the outer panel at an interface, and the inner panel may define at least a portion of a hot gas flow path through a gas turbine engine. A plurality of impingement holes extend through the outer panel from the outer side to the inner side of the outer panel for directing impingement air to the outer side of the inner panel. The outer and inner panels define a plurality of flow channels at the interface for effecting convective cooling of the outer panel along the flow channels between the outer and inner panels.

In accordance with another aspect of the invention, a ring segment is provided for a gas turbine engine. The ring segment may comprise an outer panel defining a structural body for the ring segment. The outer panel may have a leading edge, a trailing edge, a first mating edge, a second mating edge, an outer side and an inner side, the outer side being in communication with a source of cooling air. The ring segment may further include an inner panel including an outer side and an inner side wherein the outer side of the inner panel is attached to the inner side of the outer panel at an interface, and the inner panel may define at least a portion of a hot gas flow path through a gas turbine engine. A plurality of impingement holes extend through the outer panel from the outer side to the inner side of the outer panel for directing impingement air to the outer side of the inner panel. The outer and inner panels define a plurality of axially extending flow channels and a plurality of circumferentially extending flow channels at the interface for effecting convective cooling of the outer panel along the flow channels between the outer and inner panels.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
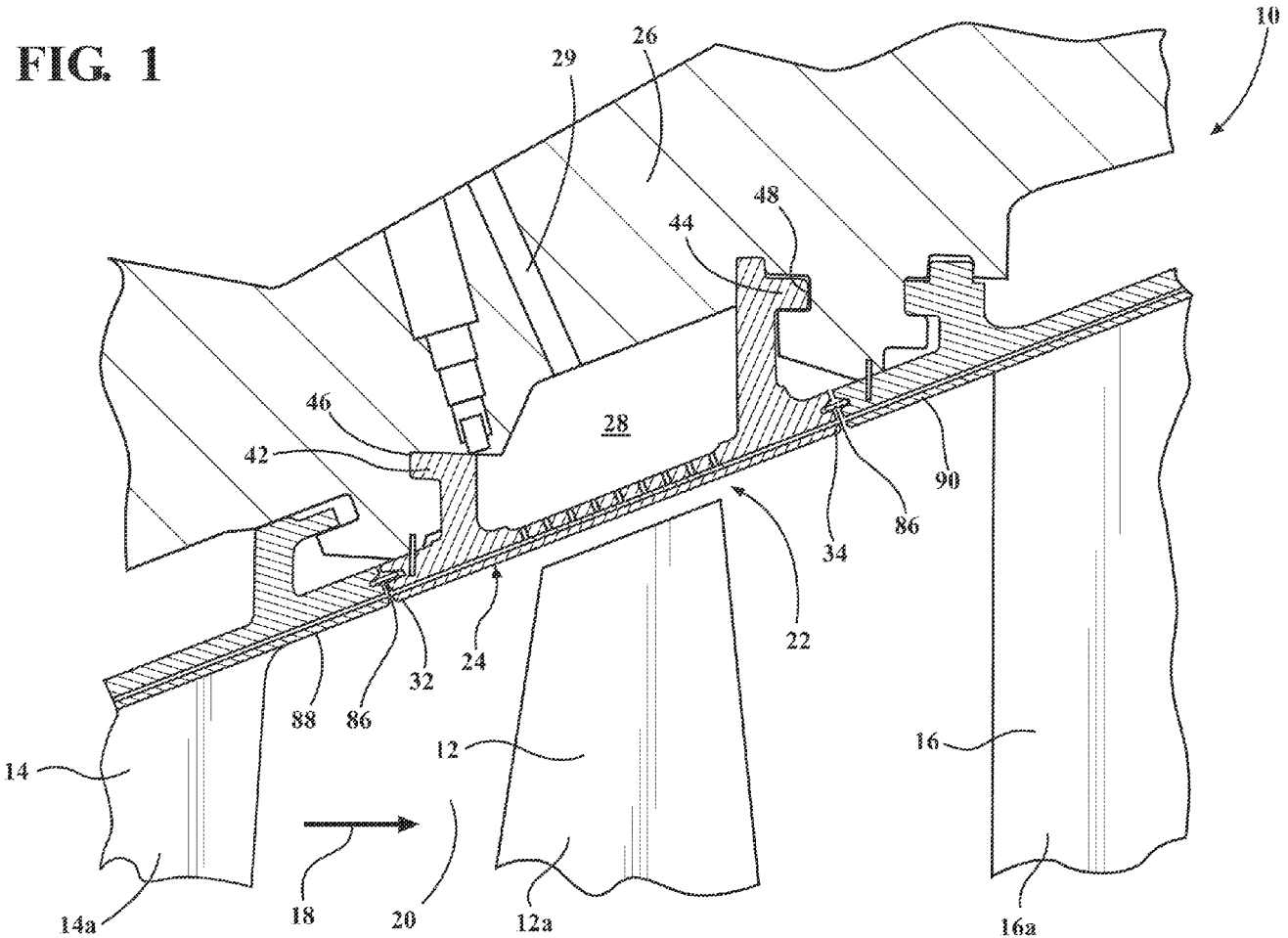
FIG. 1 is cross sectional view of a portion of a turbine section for a gas turbine engine, including a ring segment constructed in accordance with the present invention.

FIG. 1 illustrates in cross section a portion of a turbine section 10 of a gas turbine engine. Within the turbine section 10 are a series of rows of stationary vanes and rotating blades. In FIG. 1, a single blade 12 forming a row 12*a* of blades is illustrated. Also illustrated in FIG. 1 is part of an upstream vane 14 forming a row 14*a* of upstream vanes, and part of a downstream vane 16 forming a row 16*a* of downstream vanes. The blades 12 are coupled to a disk (not shown) of a rotor assembly. A hot working gas 18 from a combustor (not shown) in the engine flow in a hot gas path 20 passing through the turbine section 10. The working gas 18 expands through the turbine 10 and causes the blades 12, and therefore the rotor assembly, to rotate.

In accordance with an aspect of the invention, an outer seal structure 22 is provided about and adjacent the row 12*a* of blades. The seal structure 22 comprises a plurality of ring segments 24, which, when positioned side by side, define the seal structure 22. The seal structure 22 has a ring shape so as to extend circumferentially about its corresponding row 12*a* of blades. A seal structure 22 may be provided about each row of blades provided in the turbine section 10. The seal structure 22 comprises an inner wall of a turbine housing in which the rotating blade rows are provided and defines sealing structure for preventing or limiting the working gas from passing through the inner wall and reaching other structure of the turbine housing, such as a blade ring carrier 26 and an associated annular cooling air plenum 28.

Figure 2:
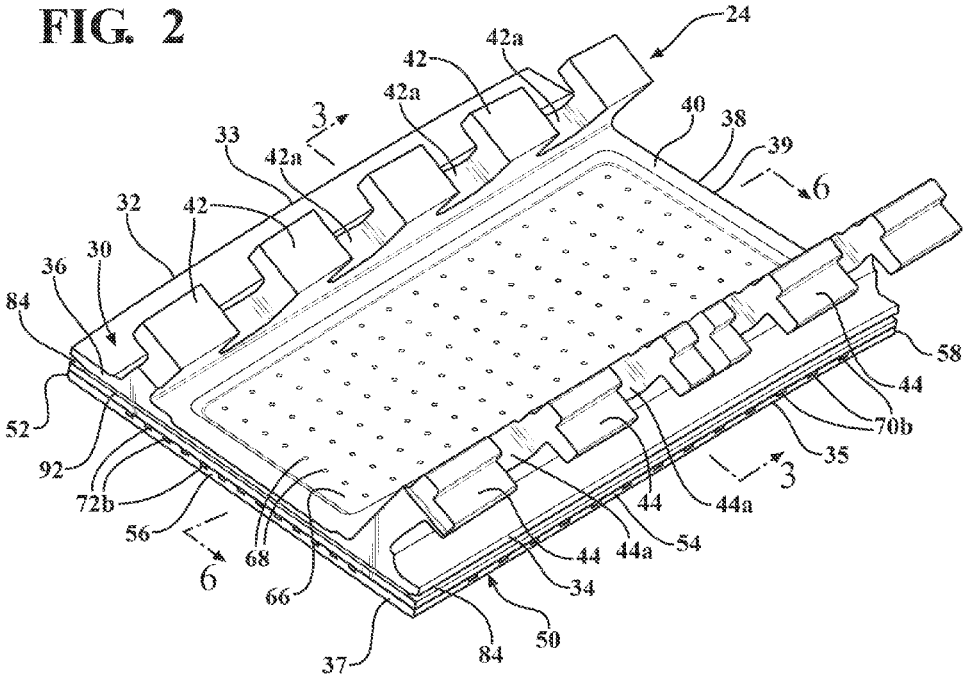
FIG. 2 is a perspective view of the ring segment illustrated in FIG. 1.
Figure 3:
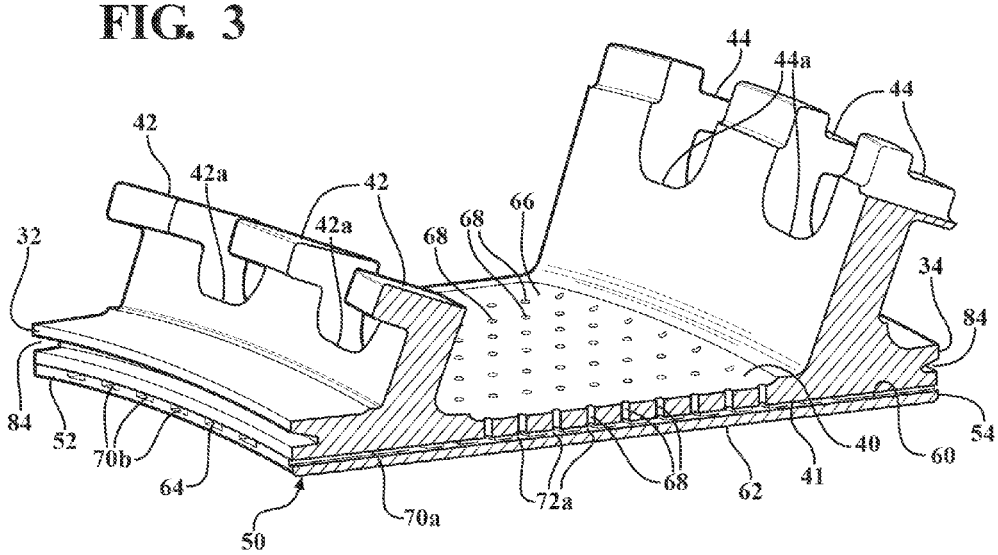
FIG. 3 is a cross sectional view of the ring segment taken along line 3-3 in FIG. 2.
Figure 4:
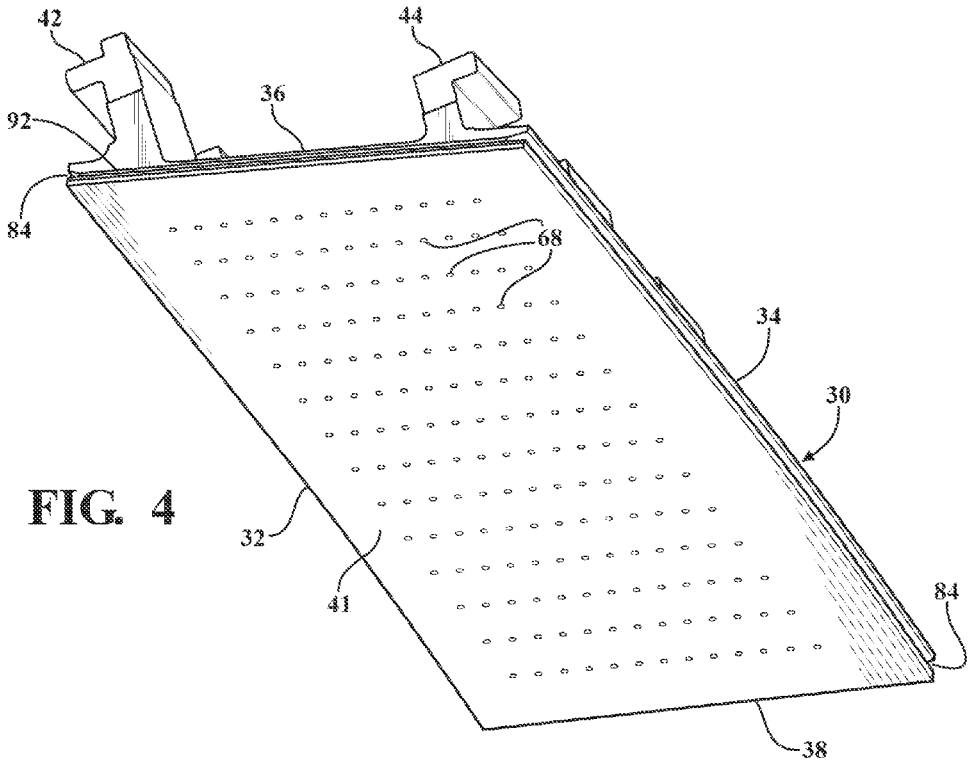
FIG. 4 is a bottom perspective view of an outer panel for the ring segment.

Referring to FIGS. 2 and 3, each ring segment 24 comprises an outer panel 30 comprising a leading edge 32, a trailing edge 34, a first mating edge 36, a second mating edge 38, an outer side 40 and an inner side 41 (FIG. 4). The outer panel 30 defines a structural body for the ring segment 24, and includes a plurality of front flanges or hook members 42 and a plurality of rear flanges or hook members 44. The front and rear hook members 42 and 44 are rigidly attached to the outer panel 30, and may be formed with the outer panel 30 as an integral casting, or may be formed separately and subsequently rigidly attached to the outer panel 30. Hence, the hook members 42, 44 may be formed of the same material or a different material than the outer panel 30. Each ring segment 24 is mounted within the turbine section 10 via the front hooks 42 engaging a corresponding structure 46 of the blade ring carrier 26, and the rear hooks 44 engaging a corresponding structure 48 of the blade ring carrier 26, as seen in FIG. 1. The outer side 40 of the outer panel 30 defines, in cooperation with the blade ring carrier 26, the annular cooling air plenum 28 to define a source of cooling air for the ring segment 24, as is described further below. The cooling air plenum 28 receives cooling air through a channel 29 from a source of cooling air, such as bleed air from a compressor for the gas turbine engine.

Each ring segment 24 further comprises an inner panel 50 affixed to the outer panel 30. In particular, referring to FIG. 5, the inner panel 50 comprises a leading edge 52, a trailing edge 54, a first mating edge 56, a second mating edge 58, an outer side 60 and an inner side 62. The inner panel 50 may be formed of a material similar to the material of the outer panel 30. For example, and without limitation, both the outer panel 30 and the inner panel 50 may be formed of a nickel based alloy. Alternatively, the inner panel 50 may be formed of a material different than the outer panel 30. The outer side 60 of the inner panel 50 is attached to the inner side 41 of the outer panel 30. In a preferred embodiment, the inner panel 50 may be affixed to the outer panel 30 by diffusion bonding at an interface 64 between the outer and inner panels 30, 50 to form a substantially integral structure having minimal variation in material characteristics at the interface 64, see FIG. 3.

Referring to FIG. 2, the inner panel 50 is configured and attached to the outer panel 30 such that the edges 52, 54, 56, 58 of the inner panel 50 substantially correspond in location to the edges 32, 34, 36, 38 of the outer panel 30. The leading edges 32, 52 of the outer and inner panels 30, 50 define a leading edge 33 of the ring segment 24, the trailing edges 34, 54 of the outer and inner panels 30, 50 define a trailing edge 35 of the ring segment 24, the first mating edges 36, 56 of the outer and inner panels 30, 50 define a first mating edge 37 of the ring segment 24, and the second mating edges 38, 58 of the outer and inner panels 30, 50 define a second mating edge 39 of the ring segment 24.

As seen in FIGS. 2 and 3, the outer side 40 of the outer panel 30 is formed with an indented or recessed central area defining an impingement portion 66 of the outer panel 30. The impingement portion 66 includes a plurality of impingement holes 68 extending through the outer panel 30 from the outer side 40 to the inner side 41, see FIG. 3, and located in axially and circumferentially extending rows. The impingement holes 68 direct impingement air from the cooling air source formed by the plenum 28 toward channels formed at the interface 64 between the outer and inner panels 30, 50. It should be noted that the impingement portion 66 need not comprise an indented or recessed area and may comprise, for example, an area that is substantially planar with a surrounding area of the outer panel 30.

Figure 5:
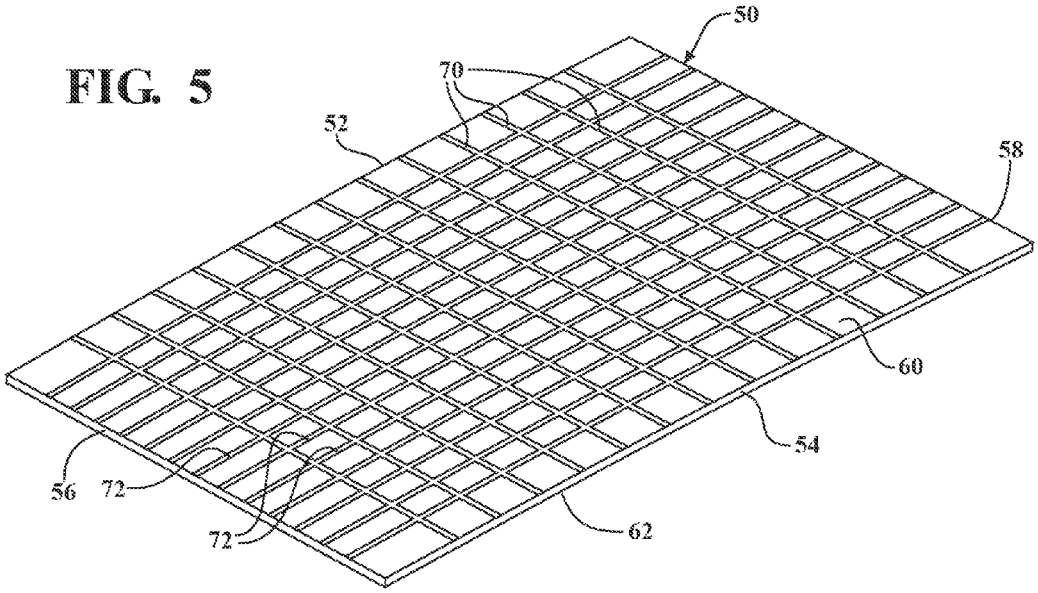
FIG. 5 is a top perspective view of an inner panel for the ring segment.
Figure 6:
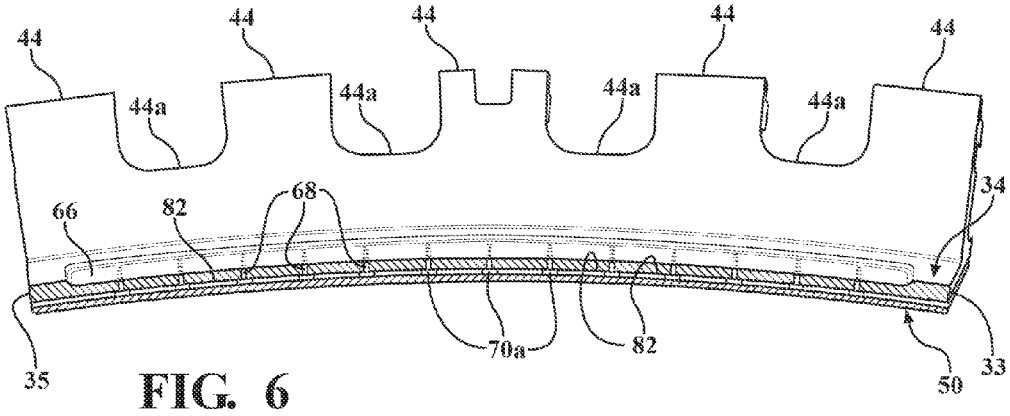
FIG. 6 is cross sectional view of the ring segment taken along line 6-6 in FIG. 2.

Referring to FIG. 5, the outer side 60 of the inner panel 50 includes grooved portions defined by a plurality of axially extending grooves 70 and circumferentially extending grooves 72. The grooves 70, 72 may be formed by a known process such as grinding or laser cutting. The axially extending grooves 70 in association with the inner side 41 of the outer panel 30 define axial flow channels 70*a* (FIG. 6) comprising continuous passages from the leading edge 33 to the trailing edge 35 of the ring segment 24. The circumferentially extending grooves 72 in association with the inner side 41 of the outer panel 30 define circumferential flow channels 72*a* (FIG. 3) comprising continuous passages from the first mating edge 37 to the second mating edge 39 of the ring segment 24. Exit openings 70*b* of the axial flow channels 70*a* are located at the leading and trailing edges 33 and 35 of the ring segment 24, and exit openings 72*b* of the circumferential flow channels 72*a* are located at the first and second mating edges 37 and 39 of the ring segment 24, see FIG. 2.

Figure 7:
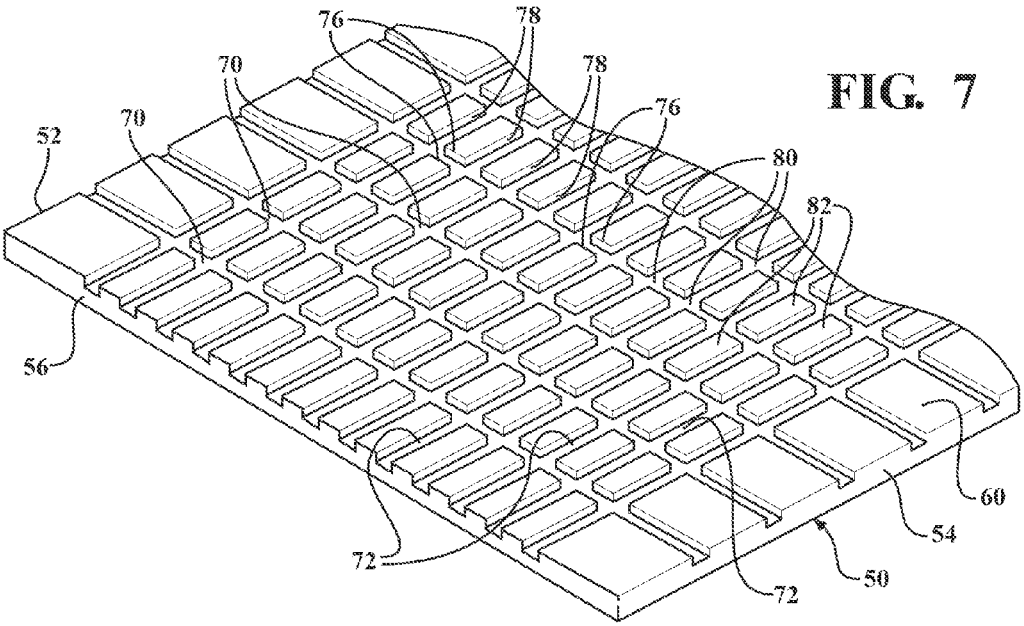
FIG. 7 is an enlarged perspective view of a portion of the inner panel for the ring segment.

As can be seen in FIG. 7, each axially extending groove 70, forming a flow channel 70*a*, is defined by a pair of opposing axial wall portions 76, and each circumferentially extending groove 72, forming a flow channel 72*a*, is defined by a pair of opposing circumferential wall portions 78. As may be seen in FIGS. 3 and 6, the width of the axially and circumferentially extending flow channels 70*a* and 72*a* defined by the respective grooves 70 and 72, in a direction parallel to the outer side 60 of the inner panel 50 may be less than the spacing between the impingement holes 68 in the circumferential and axial directions, respectively. The particular width of the grooves 70, 72 forming the flow channels 70*a*, 72*a* may be selected depending on the cooling requirements of the ring segment 24 for a particular engine design. Further, the axially extending grooves 70 and circumferentially extending grooves 72 intersect at intersections 80. Hence, the corresponding axial and circumferential flow channels 70*a*, 72*a* are configured as a grid of intersecting flow channels 70*a*, 72*a* in fluid communication with each other and intersecting at the intersections 80 within the ring segment 24.

Portions of the outer side 60 of the inner panel 50 extending between the wall portions 76, 78 of adjacent ones of the flow channels 70*a*, 72*a* comprise attachment portions 82 of the inner panel 50 for attachment to the outer panel 30. In the illustrated embodiment, the attachment portions 82 are configured as rectangular areas located between the adjacent grooves 70, 72, as seen in FIG. 7. It should be understood that the size and number of attachment portions 82 will vary depending on the number and spacing of the grooves 70, 72 formed in the outer side 60 of the inner panel 50. As noted above, the inner panel 50 may be attached to the outer panel 30 by a bonding process, such as diffusion bonding, wherein the outer side 60 of the inner panel 50 may be diffusion bonded at discrete locations defined by the attachment portions 82 to corresponding locations on the inner side 41 of the outer panel 30. The process of bonding the inner panel 50 to the outer panel 30 completes the formation of the flow channels 70*a*, 72*a* wherein the inner side 41 of the outer panel 30 defines outer surfaces for the flow channels 70*a*, 72*a*.

The impingement holes 68 are located such that they are axially and circumferentially aligned with the intersections 80 of the axial and circumferential flow channels 70*s*, 72*a*. In one aspect of the invention, an impingement hole 68 may be provided at each intersection location. In an alternative aspect, an impingement hole 68 may be provided at every other intersection 80 or at other intervals relative to the flow channels 70*a*, 72*a*.

The impingement holes 68 direct impingement air from the cooling air plenum 28 toward the inner panel 50, i.e., at the intersections 80, to provide distributed impingement cooling to the inner panel 50. Further, the flow channels 70*a*, 72*a* distribute the cooling air entering through the impingement holes 68 axially and circumferentially to provide convective cooling to the outer panel 30, as well as to the inner panel 50. The distributed impingement holes 68 provide cool cooling air across a substantial area of the ring segment 24 such that the cooling air flowing through the flow channels 70*a*, 72*a* is replenished by cool air along the length of the flow channels 70*a*, 72*a* located adjacent the impingement portion 66. That is, although the cooling air flows along the length of the flow channels 70*a*, 72*a*, it does not experience overheating in that the impingement cooling air is supplied to the flow channels 70*a*, 72*a* at regular intervals to ensure cool air is available for convective cooling along the length of the flow channels 70*a*, 72*a*.

The outer panel 30 may include circumferential seal slots 84 along the leading and trailing edges 32, 34 for engaging circumferential seals 86 extending between the leading and trailing edges 32, 34 and respective edges of adjacent vane platforms 88, 90, see FIG. 1. The outer panel 30 may also include axial slots 92 (only one shown) for engaging axial seals (not shown) extending to edges of adjacent ring segments (not shown).

During operation of the engine, cooling air may be supplied from the cooling air plenum 28, through the impingement holes 68 into the flow channels 70*a*, 72*a*. The cooling air may flow axially and circumferentially through the flow channels 70*a*, 72*a* to the respective exit openings 70*b*, 72*b*, providing cooling in the gaps between the ring segment 24 and adjacent components comprising the adjacent vane platforms 88, 90 and adjacent ring segments.

The present construction for the ring segment 24 permits relatively long flow channels 70*a*, 72*a* to be defined within the interior of the ring segment 24, by forming the grooves 70, 72 in the outer side 60 of the inner panel 50. Thus, manufacturing limitations, such as may be associated with drilling long holes through a ring segment may be avoided.

It is believed that the present configuration for the ring segment 24 provides an efficient cooling of the outer and inner panels 30, 50 via the impingement and convective cooling within the flow channels 70*a*, 72*a* extending through the ring segment 24, and that the efficient cooling of the ring segment 24 may result in a lower cooling air requirement than prior art ring segments. Hence, enhanced cooling may be provided within the ring segment 24 while minimizing the volume of cooling air discharged from the ring segment 24 into the hot working gas 18, with an associated improvement in engine efficiency. Further, the distributed cooling provided in the ring segment flow channels 70*a*, 72*a* may improve the uniformity of temperature distribution across the ring segment 24, with an associated reduction in the metal temperature and reduction in thermal stress, resulting in an improved or extended life of the ring segment 24.

The configuration of the inner panel 50 including the flow channels 70*a*, 72*a* defined by the grooves 70, 72 is believed to facilitate a reduction of thermal stress within the outer and inner panels 30, 50 with an associated reduction in stresses transferred to the ring segment support structure comprising the hook members 42, 44, thereby improving the fatigue life of the ring segment 24. Also, as noted above, the described bonding of the outer and inner panels 30, 50, including a non-welded connection between the outer and inner panels 30, 50, such as by diffusion bonding, is believed to avoid variations in material characteristics of the ring segment 24 that could otherwise result in increased stresses and cracks at the bond locations defined at the interface 64.

It may be noted that although cooling efficiency is believed to be maximized by locating the impingement holes 68 at the intersection 80 of the flow channels 70*a*, 72*a*, at certain locations on the ring segment 24 it may be desirable to provide a lower cooling efficiency. For example, in order to reduce the thermal gradient in the area of scallops 42*a*, 44*a* (FIGS. 3 and 4) defined between the hook members 42, 44, it may be desirable to reduce the cooling effect provided by the impingement holes 68. A reduced cooling effect may be accomplished, for example, by displacing the impingement holes 68 located near the scallops 42*a*, 44*a* to locations along the flow channels 70*a*, 72*a* away from the intersections 80.

As noted above, the inner panel 50 could be formed of a different material than the outer panel 30. For example, in some applications it may be desirable to select the alloy for the inner panel 50 with reference to its function of defining a portion of the hot gas path 20 with its inner surface 62 in contact with the hot working gas 18, while an alloy for the outer panel 50 may be selected with reference to its function of providing structural support for the ring segment 24. Selection of different materials for the outer and inner panels 30, 50 may be made to reduce the overall cost and/or to improve the durability of the ring segment 24. In addition, the thermal resistance of the inner panel 50 to the hot working gas 18 may be further improved by provision of a thermal barrier coating to the inner side 62 of the inner panel 50. Also, a rub tolerance alloy, different from the material forming the inner panel 50, may be provided to the inner surface 62 of the inner panel 50 to provide clearance control relative to the tips of the blades 12. Further, film cooling holes (not shown) may be provided extending from locations adjacent the axial ends of the axial flow channels 70*a*, i.e., adjacent the exit openings 70*b*, passing through the inner panel 50 to provide film cooling to the inner side 62 of the inner panel 50.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A ring segment for a gas turbine engine comprising:

an outer panel defining a structural body for the ring segment, the outer panel having a leading edge, a trailing edge, a first mating edge, a second mating edge, an outer side and an inner side, the outer side being in communication with a source of cooling air;

an inner panel including an outer side and an inner side wherein the outer side of the inner panel is attached to the inner side of the outer panel at an interface, the inner panel defining at least a portion of a hot gas flow path through a gas turbine engine;

a plurality of impingement holes extending through the outer panel from the outer side to the inner side of the outer panel for directing impingement air to the outer side of the inner panel, wherein the impingement holes are arranged in an impingement hole grid pattern; and the outer and inner panels define a plurality of flow channels at the interface for effecting convective cooling of the outer panel along the flow channels between the outer and inner panels wherein the flow channels intersect to form a flow channel grid pattern and wherein the impingement hole grid pattern corresponds to the flow channel grid pattern.

2. The ring segment of claim 1, wherein the impingement holes are aligned with the flow channels such that impingement cooling air is directed to portions of the outer side of the inner panel that define the flow channels.

3. The ring segment of claim 2, wherein the inner side of the outer panel is in engagement with and bonded to the outer side of the inner panel along portions of the inner panel surrounding the flow channels.

4. The ring segment of claim 3, wherein the outer panel is bonded to the inner panel with a diffusion bond.

5. The ring segment of claim 2, wherein the impingement holes direct cooling air from the supply of cooling air to impinge on the outer side of the inner panel at intersections formed by the flow channel grid pattern.

6. The ring segment of claim 1, wherein the flow channels are formed by grooved portions in the outer side of the inner panel.

7. The ring segment of claim 6, wherein the impingement holes direct cooling air from the supply of cooling air to impinge on the outer side of the inner panel at the intersections formed by the flow channel grid pattern.

8. The ring segment of claim 6, wherein the flow channels include axial flow channels extending from the leading edge to the trailing edge and circumferential flow channels extending from the first mating edge to the second mating edge.

9. The ring segment of claim 8, including axial exit openings at the ends of the axial flow channels at the leading and trailing edges, and circumferential exit openings at the ends of the circumferential flow channels at the first and second mating edges, wherein cooling air entering the ring segment through the impingement holes exits the ring segment through the axial and circumferential exit openings.

10. The ring segment of claim 1, including hook members rigidly attached to the outer panel for supporting the ring segment to an outer casing of a turbine engine.

11. A ring segment for a gas turbine engine comprising:

an outer panel defining a structural body for the ring segment, the outer panel having a leading edge, a trailing edge, a first mating edge, a second mating edge, an outer side and an inner side, the outer side being in communication with a source of cooling air;

an inner panel including an outer side and an inner side wherein the outer side of the inner panel is attached to the inner side of the outer panel at an interface, the inner panel defining at least a portion of a hot gas flow path through a gas turbine engine;

a plurality of impingement holes extending through the outer panel from the outer side to the inner side of the outer panel for directing impingement air to the outer side of the inner panel, wherein the impingement holes are arranged in an impingement hole grid pattern; and the outer and inner panels define a plurality of axially extending flow channels and a plurality of circumferentially extending flow channels at the interface for effecting convective cooling of the outer panel along the flow channels between the outer and inner panels wherein the flow channels intersect to form a flow channel grid pattern and wherein the impingement hole grid pattern corresponds to the flow channel grid pattern.

12. The ring segment of claim 11, wherein the impingement holes direct cooling air from the supply of cooling air to impinge on the outer side of the inner panel at intersections formed by the flow channel grid pattern.

13. The ring segment of claim 12, wherein the inner side of the outer panel is in engagement with and bonded to the outer side of the inner panel along portions of the inner panel in between adjacent ones of the flow channels.

14. The ring segment of claim 13, wherein the outer panel is bonded to the inner panel with a diffusion bond.

15. The ring segment of claim 12, wherein the axially and circumferentially extending flow channels are formed by grooved portions in the outer side of the inner panel.

16. The ring segment of claim 12, wherein the axial flow channels extend from the leading edge to the trailing edge and the circumferential flow channels extend from the first mating edge to the second mating edge.

17. The ring segment of claim 16, including axial exit openings at the ends of the axial flow channels at the leading and trailing edges, and circumferential exit openings at the ends of the circumferential flow channels at the first and second mating edges, wherein cooling air entering the ring segment through the impingement holes exits the ring segment through the axial and circumferential exit openings.

18. The ring segment of claim 12, including hook members rigidly attached to the outer panel for supporting the ring segment to an outer casing of a turbine engine.

* * * * *